US005799345A

United States Patent [19]

Hansen et al.

[11] Patent Number: 5,799,345

[45] **Date of Patent: *Sep. 1, 1998**

[54] SPA APPARATUS WITH MULTIPLE SECTIONS

[75] Inventors: Borg Hansen, Calabasas; Rafael Gonzalez, Palmdale; Roc V. Fleishman, Venice, all of Calif.

[73] Assignee: Softub, Inc., Chatsworth, Calif.

[ * ] Notice: The term of this patent shall not extend beyond the expiration date of Pat. No. 5,527,412.

[21] Appl. No.: 661,067

[22] Filed: Jun. 10, 1996

[51] Int. Cl.[6] ..... E04H 4/00

[52] U.S. Cl. ..... 4/584; 4/541.1

[58] Field of Search ..... 4/580, 585, 589, 4/592, 593, 541.1, 541.2, 541.3, 541.5, 541.6, 538, 584; 156/304.1

[56] References Cited

U.S. PATENT DOCUMENTS

| | | |
|---|---|---|
| D. 51,506 | 11/1917 | Miyahara . |
| D. 252,042 | 6/1979 | Jacuzzi . |
| D. 264,129 | 4/1982 | Tulipani . |
| D. 274,455 | 6/1984 | Cuttriss . |
| D. 293,363 | 12/1987 | Everard . |
| 817,314 | 4/1906 | Hahn . |
| 933,954 | 9/1909 | Brattin . |
| 1,450,444 | 4/1923 | McGuire . |
| 1,941,832 | 1/1934 | Gottfried . |
| 1,955,022 | 4/1934 | Rodman . |
| 2,733,711 | 2/1956 | Gibson . |
| 2,734,459 | 2/1956 | Zimsky . |
| 2,805,426 | 9/1957 | Rempel . |
| 2,844,825 | 7/1958 | Gauerke . |
| 3,157,774 | 11/1964 | Moore et al. . |
| 3,300,355 | 1/1967 | Adams . |
| 3,337,384 | 8/1967 | Wright . |
| 3,396,412 | 8/1968 | Francom . |
| 3,571,818 | 3/1971 | Jacuzzi . |
| 3,720,964 | 3/1973 | Thomson . |
| 3,734,811 | 5/1973 | Small et al. . |
| 3,772,714 | 11/1973 | Sealby et al. . |
| 3,886,936 | 6/1975 | Wehrenberg . |
| 3,923,573 | 12/1975 | Hay, II . |
| 3,943,580 | 3/1976 | Carter . |
| 3,970,210 | 7/1976 | Katsuta . |
| 4,118,814 | 10/1978 | Holtom . |
| 4,349,434 | 9/1982 | Jaworski . |
| 4,546,900 | 10/1985 | Lackey . |
| 4,564,962 | 1/1986 | Castleberry et al. . |
| 4,579,617 | 4/1986 | Oberg et al. . |
| 4,602,392 | 7/1986 | Grier et al. ..... 4/572.1 |
| 4,606,083 | 8/1986 | Kingston ..... 4/499 X |
| 4,658,448 | 4/1987 | Rogers et al. . |
| 4,679,545 | 7/1987 | Cavestany . |

(List continued on next page.)

FOREIGN PATENT DOCUMENTS

| | | |
|---|---|---|
| 312885 | 4/1989 | European Pat. Off. . |
| 1227969 | 4/1960 | France . |
| 2087513 | 12/1971 | France . |
| 3204323 | 8/1983 | Germany . |
| 3320617 | 7/1984 | Germany . |
| 3602771 | 10/1986 | Germany . |
| 3610823 | 7/1987 | Germany . |
| 4032448 | 1/1992 | Germany . |
| 6142156 | 5/1994 | Japan . |
| 904763 | 8/1962 | United Kingdom . |
| 1381723 | 1/1975 | United Kingdom . |
| 1592982 | 7/1981 | United Kingdom . |
| 2171008 | 8/1986 | United Kingdom . |

*Primary Examiner*—James Engel
*Attorney, Agent, or Firm*—William W. Haefliger

[57] ABSTRACT

The method of providing a spa tub, and comprising providing a load-bearing tub side wall having an inner side and an outer side, the tub having an interior to receive liquid; the tub side wall provided to include at least two wall sections, spaced about the interior, the sections assembled end-to-end to form the side wall to extend in a loop, the sections consisting of synthetic resin; each section having inner and outer panels extending upright throughout the major upright extent of the side wall.

37 Claims, 14 Drawing Sheets

U.S. PATENT DOCUMENTS 4,699,288 10/1987 Mohan .
4,829,607 5/1989 Huse .
4,843,659 7/1989 Popovich et al. .
4,858,254 8/1989 Popovich et al. .
4,901,379 2/1990 Chalberg et al. .
4,981,543 1/1991 Popovich et al. .
5,022,101 6/1991 Gosselin et al. .
5,092,951 3/1992 Popovich et al. .
5,428,849 7/1995 Watkins et al. .
5,454,195 10/1995 Hallsten .
5,527,412 6/1996 Hansen et al. ..... 156/215
5,548,852 8/1996 Rowe .

SPA APPARATUS WITH MULTIPLE SECTIONS

BACKGROUND OF THE INVENTION

This invention relates generally to hot tubs or spas, more particularly to an easy to manufacture, low-cost, lightweight, insulated, semi-rigid plastic spa, which is made in multiple sections.

Conventional hot tubs or spas are bulky, heavy, non-portable, and expensive in their construction; also expensive electrical energy and heat energy is required for their operation. There is need for a greatly improved, easily fabricated and assembled spa structure, with the unusual advantages in construction, modes of operation, use and transport, and results, as are now made possible by the present invention, as will appear.

SUMMARY OF THE INVENTION

It is a major object of the invention to provide a method of forming an improved hot tub or spa, easy to assemble from multiple sections, and meeting the above needs. Basically, the method of the invention is accomplished by:

a) providing a load-bearing tub side wall having an inner side and an outer side, the tub having an interior to receive liquid, b) the tub side wall provided to include at least two wall sections, spaced about the interior, the sections assembled end-to-end to form the side wall to extend in a loop, the sections consisting of synthetic resin, c) each section having inner and outer panels extending upright throughout the major upright extent of the side wall.

As will be seen, the tub wall typically includes at least three of the wall sections, easily assembled end-to-end, with outer wall panels connected end-to-end, and the reinforcing inner wall panels also connected end to end. Cavities are provided between the inner and outer panels of the section, and water ducting is located in certain of such cavities.

Another object is to provide retention band means extending in a loop about the interconnected sections, to resist their outward deflection.

A further object is to provide inner panels which overlap adjacently connected ends of outer panels, in one form of the invention; and in another form of the invention, the inner panels are formed endwise co-extensive with the outer panels, and are integral therewith, as by provision of integral webs connecting the inner and outer panels.

A further object includes provision of a flexible liner extending generally vertically at the inner side of the side wall to contain water filled into the tub interior; and also provision of a cover downwardly received in the tub interior and having an inflatable bladder to expand and transmit loading imposed downwardly on the cover to water in the tub beneath the cover. Ducting typically includes jet orifice structures communicating through the liner.

Another object includes provision of a tub side wall inner side having horizontal outline that is substantially rectangular with curved corners; and in other forms of the invention, the side wall sections extend circularly about an upright axis.

An additional object includes provision of a tub outer side wall to define an upper recess inwardly of the outer side of the tub wall and below the top level of the side wall, the upper recess sized to receive at least one of the following:

i) edge extent of a flexible, outer jacket for the side wall, the jacket extending below the recess, ii) edge extent of a shoulder jacket that extends over the top of the side wall, iii) edge extent of a tub top cover.

That recess is typically formed in the multiple outer, lightweight panels; and the tub side wall is provided to be semi-rigid and self supporting.

A further object is to provide a tub seat integral with one or more inner panels.

Yet another object is to construct the spa in multiple sections which can be assembled end-to-end, and held together by strapping enabling disassembly for storage of the sections; and employing liner material in the spa to retain spa water, within the assembled sections.

These and other objects and advantages of the invention, as well as the details of an illustrative embodiment, will be more fully understood from the following specification and drawings, in which:

DRAWING DESCRIPTION

DETAILED DESCRIPTION

Figure 3:
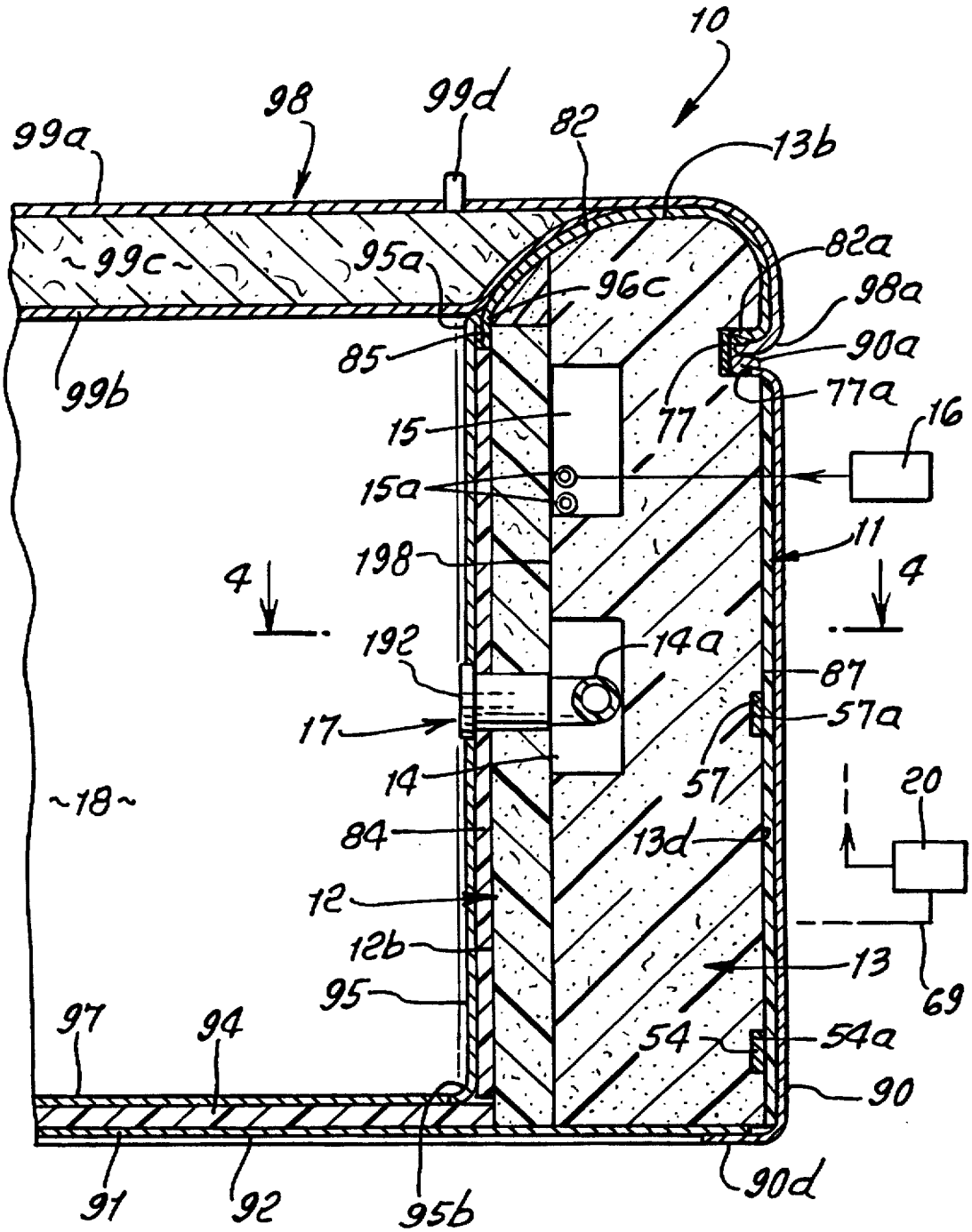
FIG. 3 is an enlarged vertical, radial section taken through the tub wall, and taken on lines 3—3 of FIG. 1.

In FIGS. 1–5, a tub or spa 10 has a looping, upstanding, self-supporting, lightweight side wall 11. The wall includes an inner panel or panels 12, and an outer panel or panels 13. These panels, 12 and 13, extend upright throughout substantially the entire height of the side wall 11. Such panels typically consist of synthetic resin, and examples are foamed or gas-expanded polystyrene, and foamed or gas-expanded polypropylene, formed as solid curved blocks or sections that interfit, as for example is shown in FIG. 3, and may be adhesively bonded together at their interfit locations. The sections may be held together by strapping, to enable their disassembly.

For example, four such quadrant-shaped inner panels 12 may be interconnected end-to-end in a loop, as by adhesive bonding; and four such substantially quadrant-shaped outer panels 13 may be interconnected with the inner panels, respectively, to define the looping tub wall. Panels 12 are thinner than panels 13, and overlap the end-to-end joints formed at 13*a* by the outer panels. Panels 12 have end-to-end interconnection at joints 12*a*, located about mid way between joints 13*a*. Looping space or spaces are formed, as at 14 and 15 in outer panels 13.

Such spaces are adapted to receive ducting, as indicated at 14*a*–15*a*, for flowing air in 15*a* and water in 14*a* under pressure, to jet nozzles 17 that communicate through the thinner reinforcing inner panels 12, for delivery of aerated water jets to the tub interior 18 bounded by the wall 11. Air is typically supplied via 15*b* for mixing with water, as for example was disclosed in U.S. Pat. Nos. 4,858,254 and 4,843,659, incorporated herein by reference. Jet orifice plates are shown at 192. See U.S. patent application Ser. No. 08/336,738 now U.S. Pat. No. 5,527,412, incorporated herein by reference. Air is supplied to line 15*a* from an inlet at a warm air zone in a power pack that includes a water pump and motor drive, as disclosed in the patents, and the application. Such equipment is indicated at 16 in FIG. 3. Jet structure 17 acts to hold inner and outer panels together at interface 198.

Note that inner panel 12 interfits panel 13 at plane 98 in FIG. 3, panel 13 being much thicker than panel 12. Also, panel 12 covers the cavities 14 and 15. Accordingly, a unitary, multiple overlapping, inner and outer tub wall is achieved. The outer side 34 of outer panel 13 may be downwardly tapered, with convexity, as shown in FIG. 5. The tub of FIG. 5 is otherwise the same as that of FIGS. 1–4.

Figure 1:
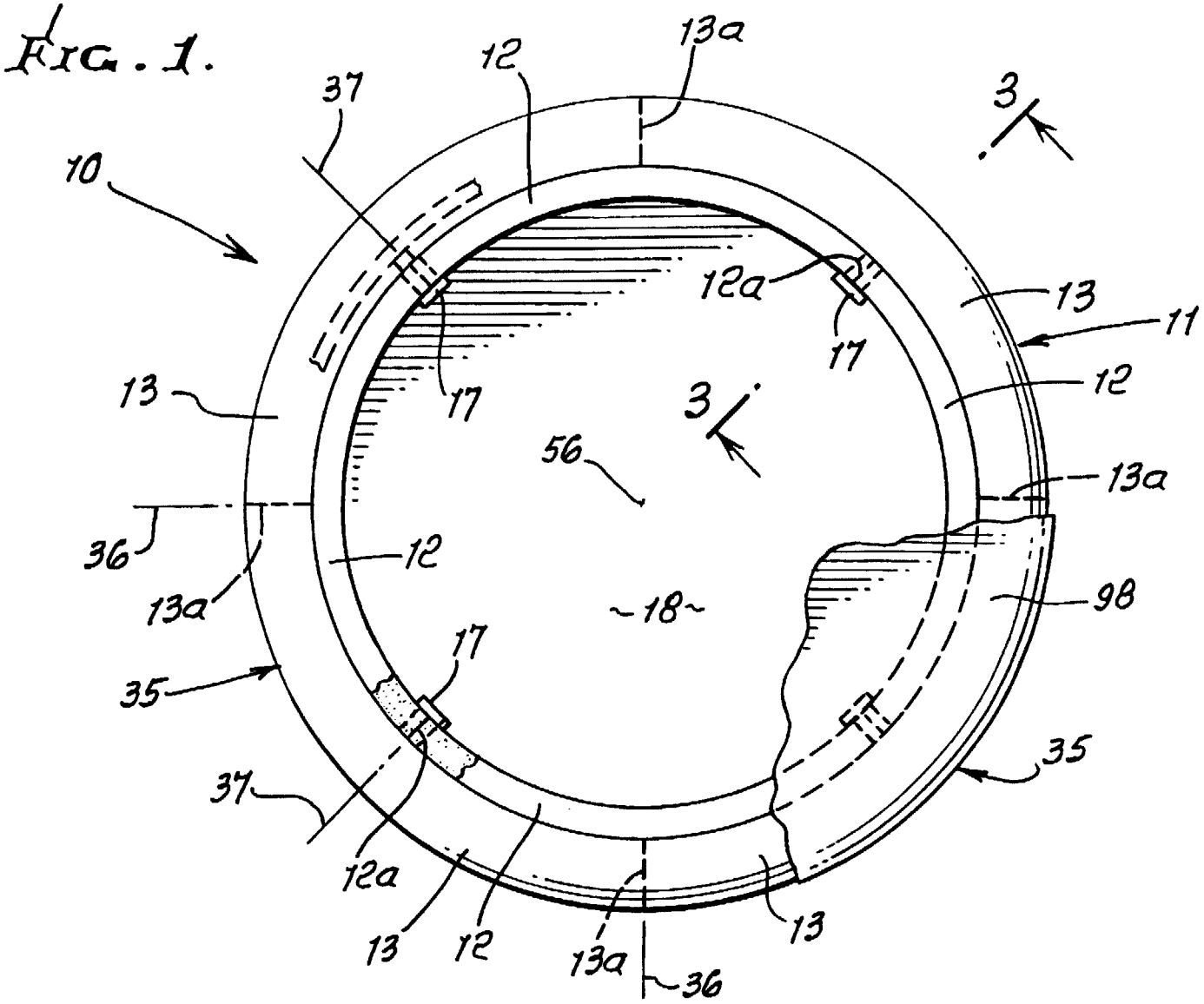
FIG. 1 is a top plan view of a hot tub or spa incorporating the invention.
Figure 2:
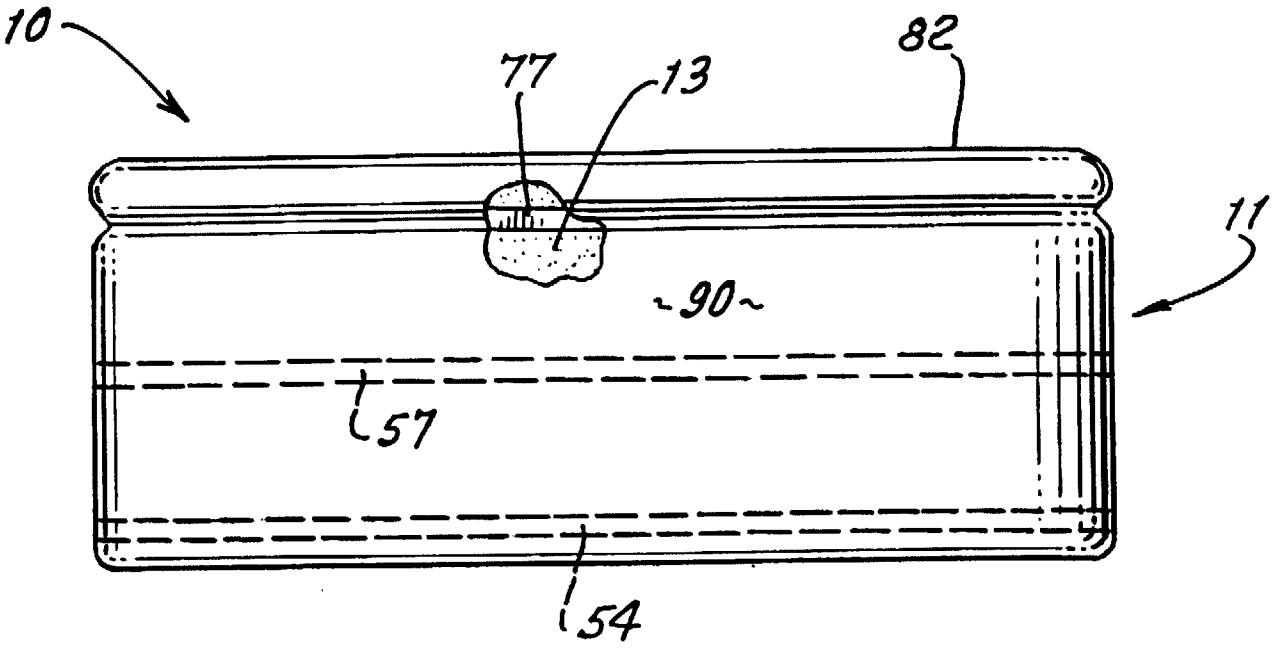
FIG. 2 is a side elevation view of the FIG. 1 hot tub or spa.

As appears in FIG. 1, the four quadrant-shaped wall sections 35 are alike and assembled end-to-end, to form a looping, upstanding, self-supporting, tub wall, capable of disassembly for storage, if the sections are not adhesively connected. The end locations of the outer panels are located at four radial axial planes 36; and the end locations of the inner panels are located at four radial axial planes 37.

Figure 4:
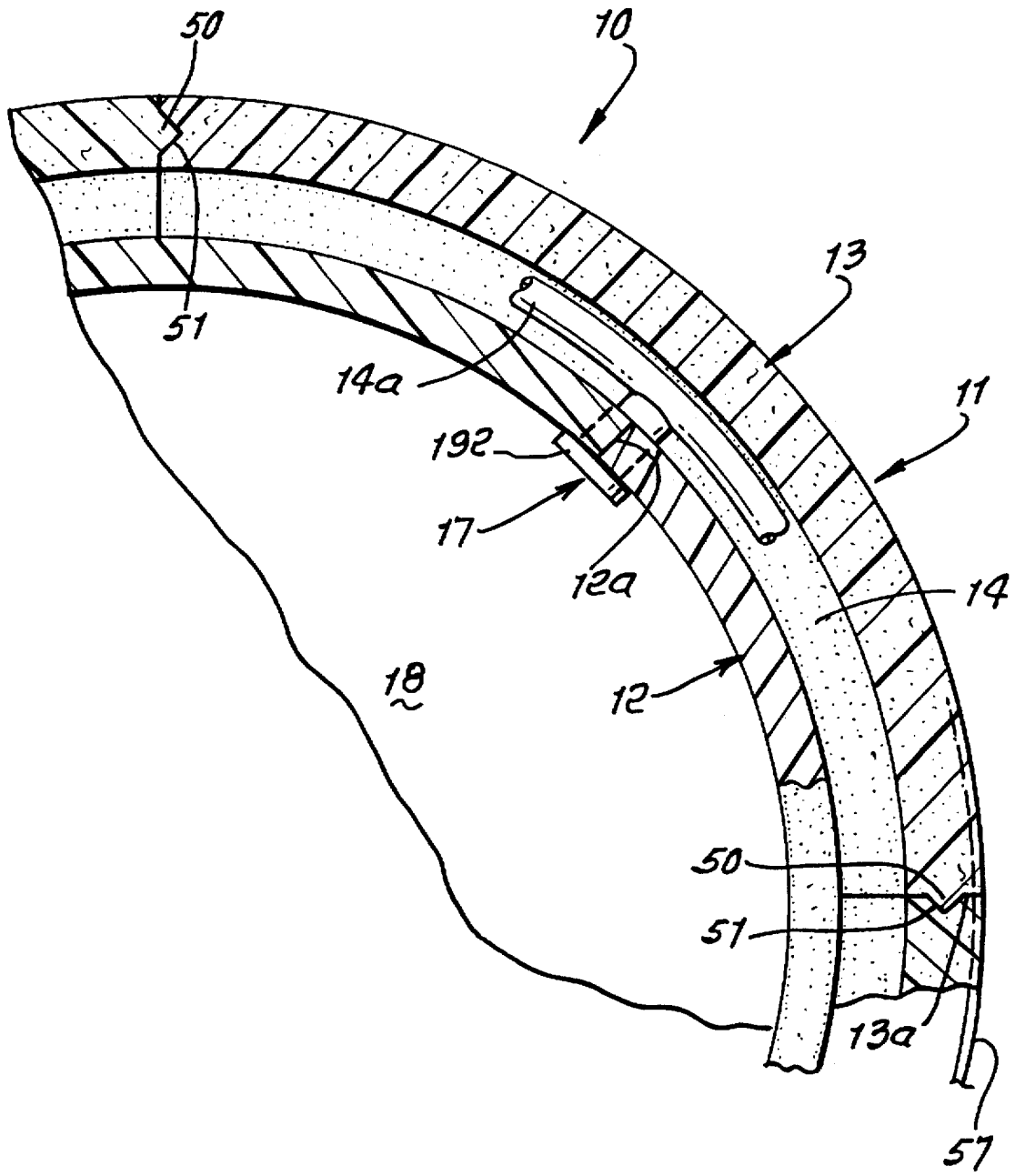
FIG. 4 is an enlarged horizontal section taken on lines 4—4 of FIG. 3.
Figure 5:
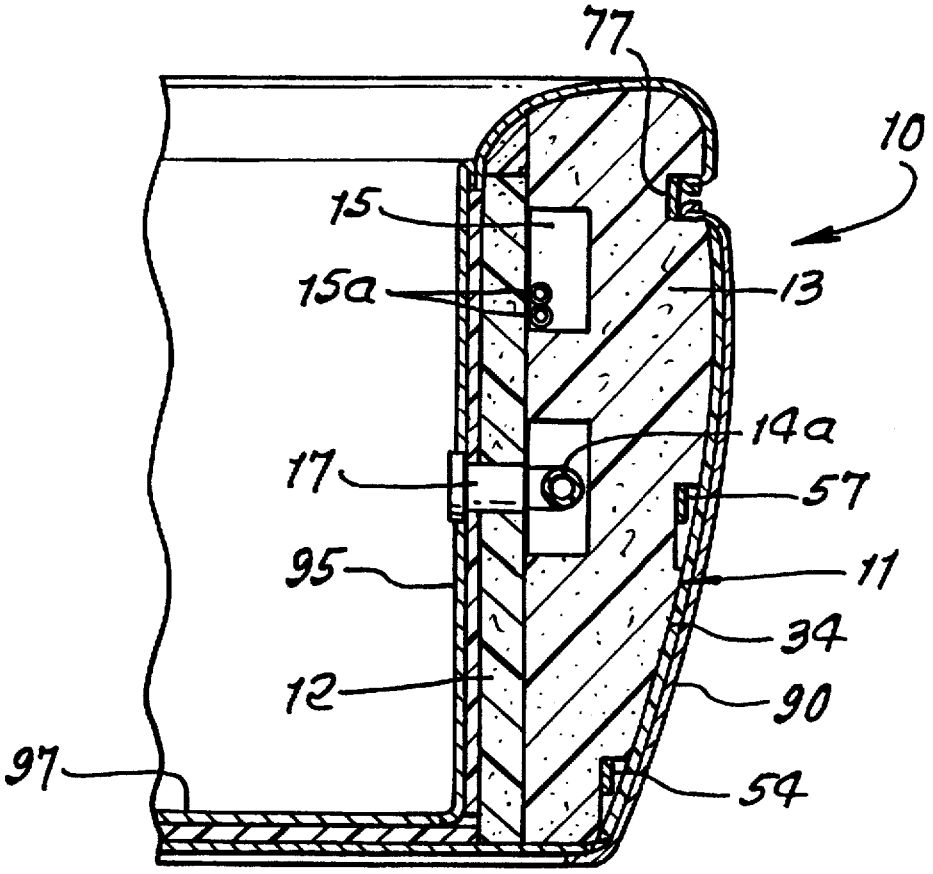
FIG. 5 is a view like FIG. 3 but showing a curved side wall modification.

The four quadrant-shaped panels 13 have circularly projecting tongues 50 and grooves 51 located at their opposite ends, as seen in FIG. 4. Tongues 50 of circularly successive outer panels interfit in grooves 51, as shown. When the outer panels 13 are interlocked, or otherwise connected, as described, the inner panels 12, as referred to above, overlap such joints, and have end-to-end interfit. Accordingly, it should be noted that each of the inner and outer panels has opposite ends, whereby adjacent inner panels have opposed opposite ends and adjacent outer panels have opposed opposite ends, the opposed ends of the outer panels offset loopwise from the opposed ends of the inner panels. Also, it will be noted that each section has opposite ends and greater thickness intermediate said opposite ends than at said opposite ends. Such a construction may be regarded as preferred. The panel assembly is, therefore, capable of transmitting hoop compressive loading. As seen in FIG. 3, such loading is effected as by a holding element, such as a tightenable or loosenable fiberglass tape or metallic strap 54 received in lower grooves or channels 54*a* in the panels 13, i.e., that extend about the central axis 56 of the tub. A similar compressive, load-exerting, holding element 57 may be received in upper channels or grooves 57*a* formed in the panels 13, to extend about the central axis 56.

A source of fluid, such as a water pump 20, circulates water under pressure to the ducts 14*a* for delivery to the jet nozzles 17 in inner panels 12, as referred to. Return ducting 69 from a quadrant-shaped section 35, re-circulates water from the tub interior to the pump unit. See for example the pump unit and circulation path, as shown in U.S. Pat. No. 5,092,951, incorporated herein by reference.

Referring to FIG. 3, an arcuate support is provided at 13*d* by panels 13 provide a comfortable arm rest, or seat, for the tub user, as for example during climbing into or out of the tub. The upper surface of the support is shown as upwardly convex, in axial radial planes; and it may extend in a complete loop in association with the tub looping upstanding wall 11. An inner pad or cushion 84 in the form of a sheet, adjacent the inner sides 12*a* of the inner panels, extends from its attachment at 85 to a top cushion layer 82, downwardly to the bottom level of the tub.

Likewise, an outer pad or cushion layer 87 extends downwardly in the form of a sheet, adjacent the outer sides 13*d* of the panels 13, from the level of recess 57*a* to the bottom level of the tub side wall. Such cushions may be bonded to walls 12*b* and 13*d*, and may consist of expanded polyethylene foam. They are resiliently compressible.

In accordance with an important aspect of the invention, a recess 77*a*, provided inwardly of the outer sides of the tub outer panels 13, and below side wall top level, is configured to receive an upper tensioning strap 77 and at least one of the following elements, and preferably all of them:

i) edge extent of a flexible, outer jacket for the side wall, the jacket extending below the recess, ii) edge extent of cushioning layer 82 that extends over the top of the side wall, iii) edge extent of a tub top cover.

The outer, flexible jacket is shown at 90 in FIG. 3, and extends adjacent or near to the outer side of the tub wall 11. Specifically, it is shown as conforming closely to the shape of the outer pad 87, i.e., extending downwardly adjacent that pad. The annular jacket 90 preferably consists of a thin sheet of marine grade polyvinyl material or similar protective outdoor fabric. The upper edge extent 90*a* of the sheet is received in the recess 77*a*. The lower annular edge extent 90*d* of the outer jacket may be attached (sewn or high-frequency welded) to a bottom sheet 92 protectively underlying the cushion layer 91 adjacent the bottom panel or wall 94 of the tub. Wall 94 is made of the same material as panels 12 and 13.

Accordingly, the jacket 90 has multiple functions, i.e., it protectively covers the outer side of the tub side wall, it retains the tub bottom wall or panel 94 in position as shown, it protectively covers the outer padding 87, and it is retained to the tub via retention at recess 77*a*, as referred to. Bottom wall 94 acts to structurally reinforce the side panels.

In similar manner, inner liner 95 seen in FIG. 3 extends adjacent or near to the inner side of the tub wall 11. Specifically, it is shown as conforming closely to the shape of the inner pad 84, i.e., extending downwardly and cylindrically, adjacent the pad. The liner 95 preferably consists of a thin sheet of waterproof, flexible, polyvinyl material, or similar waterproof, flexible sheet. Upper edge extent 95*a* of the sheet is attached to the inner lower edge portion 96*c* of shoulder cushion layer 82. The lower edge extent 95*b* of liner sheet 95 meets and is bonded to (RF weld or heat weld) the bottom vinyl sheet 97 protectively (and waterproof) overlying the bottom panel or wall 94 of the tub.

The shoulder layer or jacket 82 is preferably of marine grade (flexible), polyvinyl chloride upholstery material or equivalent, or equivalent outdoor fabric, closely overlies the panel top 13*d*, conforming to its upwardly convex curvature, as shown. The outer edge extent 82*a* of the layer 82 is also received and retained in the recess 77*a*. Accordingly, the protective jackets 90, 95 and 82 may be quickly applied to the tub, upon its assembly, and easily retained in a concealed manner to the tub.

The flexible edge extent 98*a* of a top cover 98 for the tub interior may also be received in the recess and retained therein by similar means, or simply tucked in that recess for retention. The top cover may include a bladder formed by upper and lower layers 99*a* and 99*b*, to be inflated to transfer downward loading to water in the tub. See also felt 99*c* between 99*a* and 99*b*. Inflation means appear at 99*d*.

From the foregoing, it will be seen that the side wall is of sufficient rigidity, to be self-supporting and able to support a bather's weight, seated on the shoulder jacket. The inflated cover also can support a bather's weight. The liner 95, outer jacket 90 and shoulder jacket 82 are typically thin and flexible.

Figure 6:
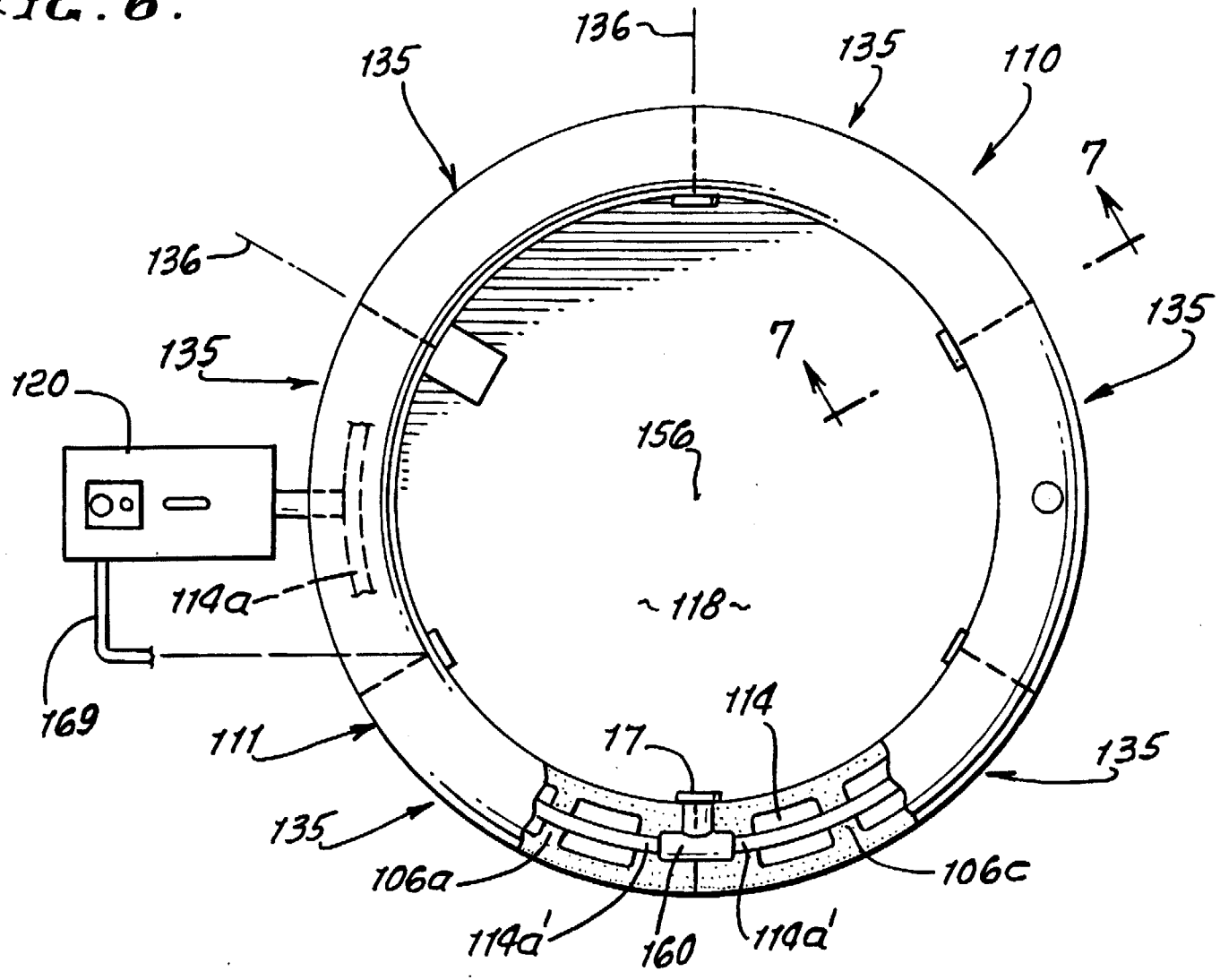
FIG. 6 is a view like FIG. 1 showing a modification having six side wall sections.
Figure 7:
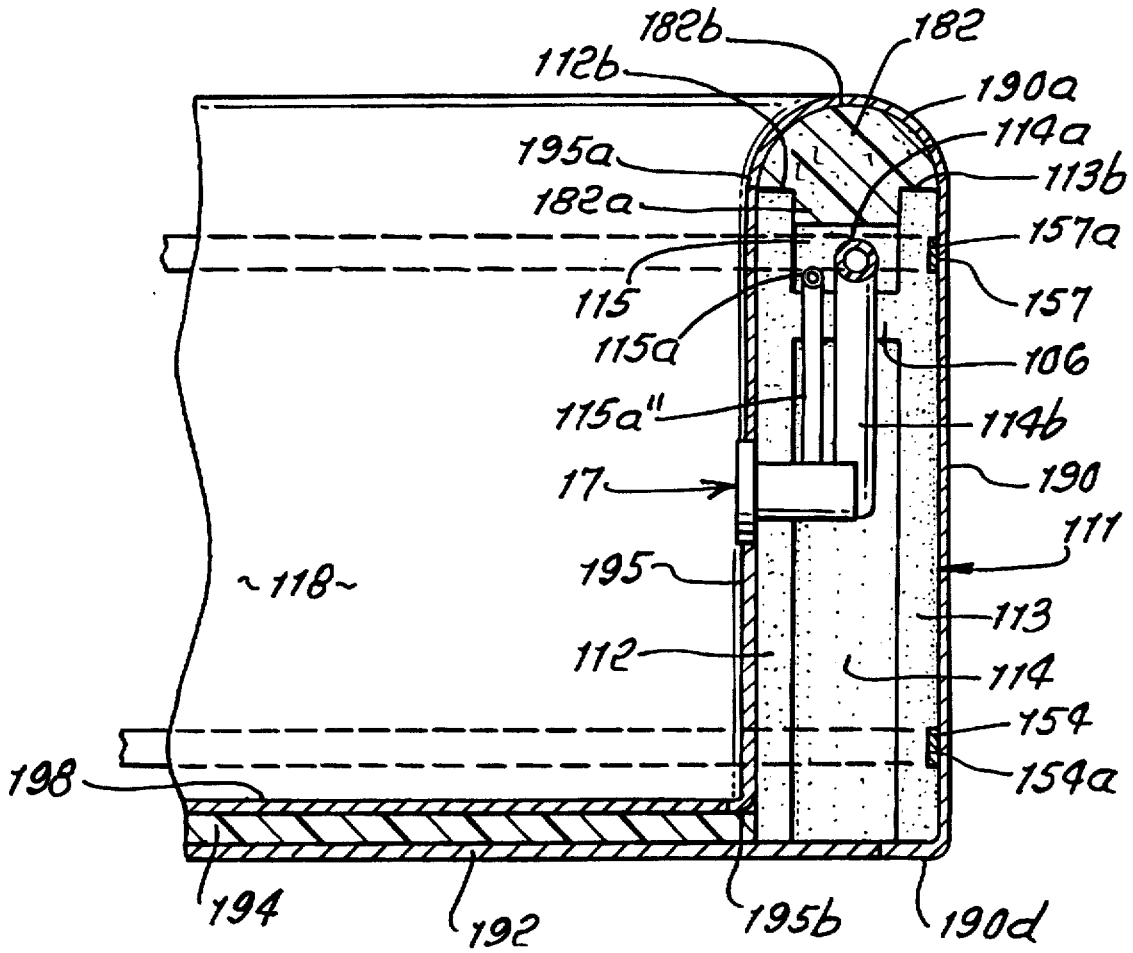
FIG. 7 is an enlarged vertical radial section taken on lines 7—7 of FIG. 6.

In the similar apparatus seen in FIGS. 6 and 7, a tub or spa 110 has a looping, upstanding, self-supporting, lightweight side wall 111. The wall includes an inner panel or panels 112, and an outer panel or panels 113, these extending upright to substantially equal extents, and throughout the major extent of the side wall 111. Such panels typically consist of synthetic resin, and examples are foamed or gas-expanded polystyrene, and foamed or gas-expanded polypropylene, formed as solid blocks that interfit, as for example is shown in FIG. 6.

For example, six such 60° sector-shaped inner panels 112 may be interconnected end-to-end in a loop, as by adhesive bonding; and six such substantially 60° sector-shaped outer panels may be interconnected (for example, integrally molded) with the substantially 60° sector inner panels, respectively, to define the looping tub wall, with interior space or spaces formed, as at 114 and 115. "Fluted" spaces 114 are loopwise interrupted and open downwardly; and "fluted" spaces 115 are loopwise interrupted and open upwardly. See also horizontal bridges 106 and vertical bridges 106*a* between the inner and outer panels and molded therewith. These spaces are adapted to receive ducting, as indicated at 114*a*--115*a*, for flowing air in 115*a* and water in 114*a* and downwardly under pressure to jet nozzles 117 that communicate below the levels of 114*a* and 115*a* through the inner panels 112 and a liner 195, for delivery of aerated water jets to the tub interior 118 bounded by the wall 111. Air is typically aspirated downwardly for mixing with water at the jets. See ducts 115*a*".

As appears in FIG. 6, the six quadrant-shaped wall sections 135 are alike, and assembled end-to-end, and adhesively bonded, to form a looping, upstanding, self-supporting, tub wall. The end locations of the sections are located at six radial axial planes 136, panels 112 and 113 terminating at those planes.

The inner and outer panels 112 and 113, interconnected at bridges 106 and 106*a*, as during molding, are capable of transmitting hoop compressive loading. As seen in FIG. 7, such loading is effected as by a holding element, such as a fiberglass tape or metallic strap 154 received in lower grooves or channels 154*a* in the panels 113, i.e., that extend about the central axis 156 of the tub. A similar compressive, load-exerting holding element 157 may be received in upper channels or grooves 157*a* formed in the panels 113, to extend about the central axis 156.

A source of fluid, such as a motor-driven water pump 120, circulates water under pressure to the ducts 114*a* for delivery at 114*b* to the jet nozzles 117 in inner panels 112, as referred to. Return ducting 169 from at least one section 135, re-circulates water from the tub interior to the pump unit. See for example the pump unit and circulation path, as shown in U.S. Pat. No. 5,092,951, incorporated herein by reference.

Referring to FIG. 7, a resiliently compressible support cushion 182, or cap, is provided to seat on the upper extents of the panels, as on their upper horizontal surfaces 112*b* and 113*b*. Cushion 182 also projects downwardly at 182*a* into spaces 115 forming a T-shaped connection. Cushion 182 provides a comfortable arm rest, or seat, for the tub user, as for example during climbing into or out of the tub. The upper surface 182*a* of the cushion is shown as upwardly convex, in axial radial planes; and it may extend in a complete loop in association with the tub looping upstanding wall 111.

An outer jacket is shown at 190 and extends adjacent or near to the outer side of the panels 113. The annular, flexible jacket 190 preferably consists of a thin sheet of marine grade polyvinyl material or similar protective outdoor fabric. The upper extent 190*a* of the jacket covers cushion 182, as shown. The lower annular edge extent 190*d* of the outer jacket may be attached (sewn or high-frequency welded) to a bottom sheet 192 protectively underlying the bottom panel or wall 194 of the tub. Accordingly, the jacket 190 has multiple functions, i.e., it protectively covers the outer side of the tub side wall, it retains the tub bottom wall or panel 194 in position as shown, it protectively covers the cushion 182, and it is retained to the tub via retention to panels 113.

In similar manner, the inner liner 195 extends adjacent or near to the inner side of the tub wall 111. Specifically, it is shown as conforming closely to the curved shape of the inner panels 112, i.e., extending downwardly and cylindrically. The liner 195 preferably consists of a thin sheet of waterproof, flexible polyvinyl material, or similar waterproof, flexible sheet. Upper edge extent 195*a* of the sheet is attached to the upper portion 190*a* of jacket 190. The lower edge extent 195*b* of liner sheet 195 meets and is bonded to (RF weld or heat weld) the bottom vinyl sheet 198 protectively (and waterproof) overlying the bottom panel or wall 194 of the tub.

The inner jacket or liner 195 is preferably of marine grade (flexible) polyvinyl chloride upholstery material or equivalent, or equivalent outdoor fabric. Accordingly, the protective jackets 190 and 195 may be quickly applied to the tub, upon its assembly, and easily retained in a concealed manner to the tub.

The flexible edge extent of a top cover for the tub interior may also be received over jacket extent 190*a*.

From the foregoing, it will be seen that the side wall is of sufficient rigidity, to be self-supporting and able to support a bather's weight, seated on the shoulder jacket. Also, the liner or jacket elements are typically thin and flexible.

FIG. 6 shows tubular pipe sections 160 extending at the joints formed by the connected ends of the sections 135, and receiving or connecting water pipe ends 114*a*".

Figure 12:
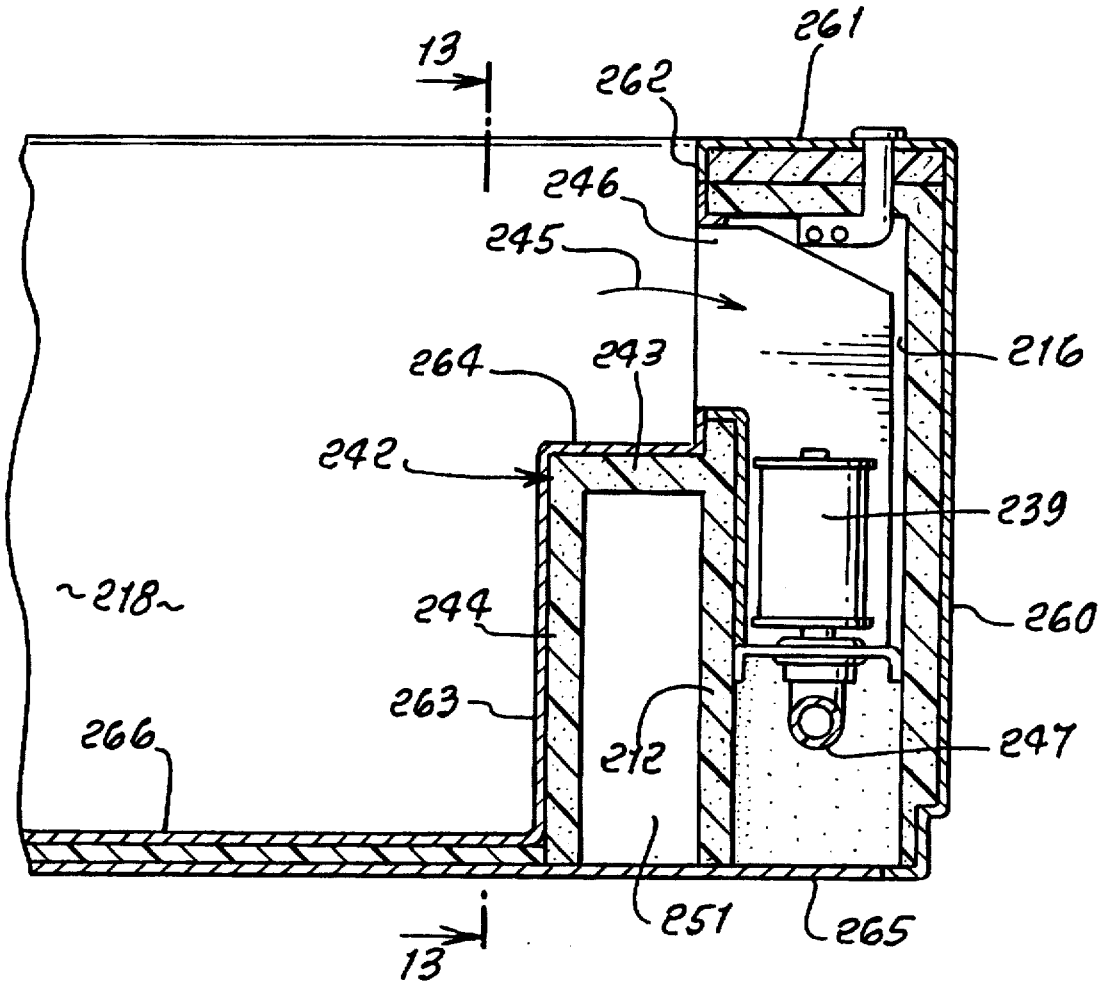
FIG. 12 is an enlarged fragmentary section taken on lines 12—12 of FIG. 10.

In the modification seen in FIGS. 10–13, the fluted construction of the upstanding wall or walls 211 is generally the same as in FIGS. 6 and 7. See inner and outer lightweight, molded plastic panels 212 and 213, horizontal bridges or ribs 206 extending between panels 212 and 213 at upper levels; upper and lower cavities 215 and 214 above and below the bridges 206; vertical bridges or ribs 206*a*, which are circularly spaced about the tub axis; and vertical cavities 216 formed between bridges 206*a*. A filter 239 is received in one of such vertical cavities 216, as seen in FIG. 12. Also shown in that view is a seat 242 projecting inwardly into the tub interior 218 from an inner panel 212, and as indicated or formed by sub-panels 243 and 244.

Figure 13:
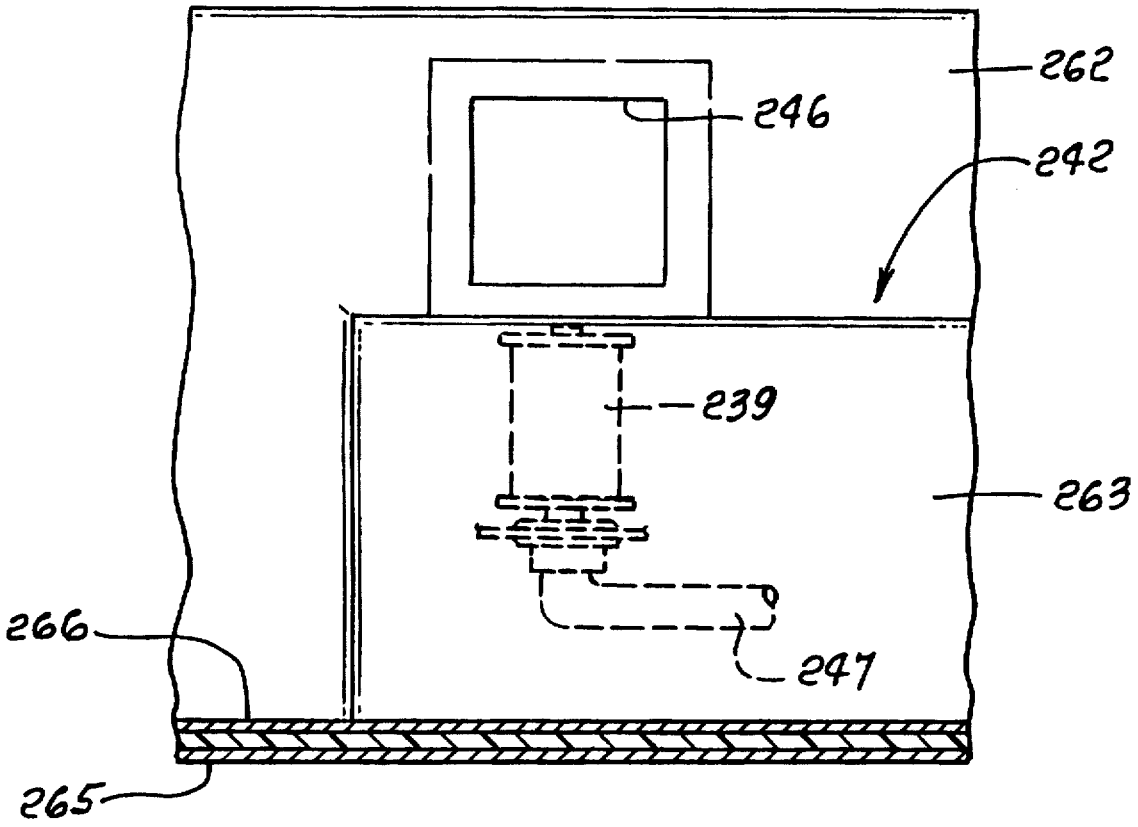
FIG. 13 is a fragmentary section taken on lines 13—13 of FIG. 12.

FIGS. 12 and 13 show flow of tub water at 245, via an opening 246 in a panel 212 and cavity 216, for delivery to the filter. From the latter, water flows via ducting 247 to a pump 250 for pumping at 249 to jets 217 seen in FIG. 10. Space 251 interiorly of the seat may house the motor and pump unit 250. An access door to the exterior appears at 291.

Liner or jacket structure is shown at 261--266 covering wall and tub bottom panel structure. Note in FIG. 10 that the tub wall has generally rectangular outline, with rounded curves, in plan view. Also, it is constructed in four generally L-shaped sections, two of which 235 are alike, and two of which 235*a* are alike. The sections are connected end-to-end, in sequence 235, 235*a*, 235, and 235*a*, as shown, and at end-to-end joints at 270, 271, 272, and 273. Note tongue and groove interfits at 280 and 281.

Figure 8:
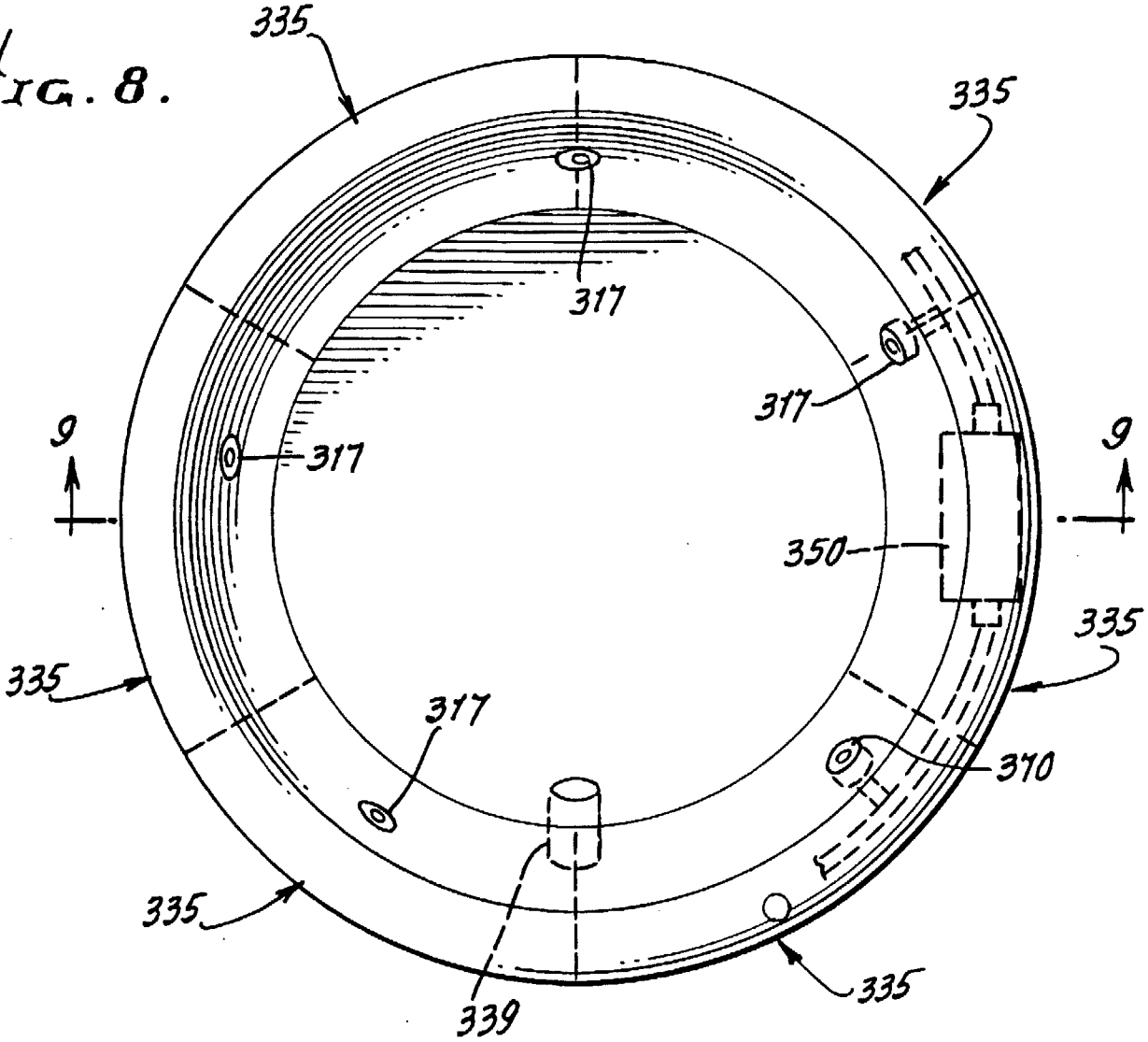
FIG. 8 is another view like FIG. 1 showing a further modification.
Figure 9:
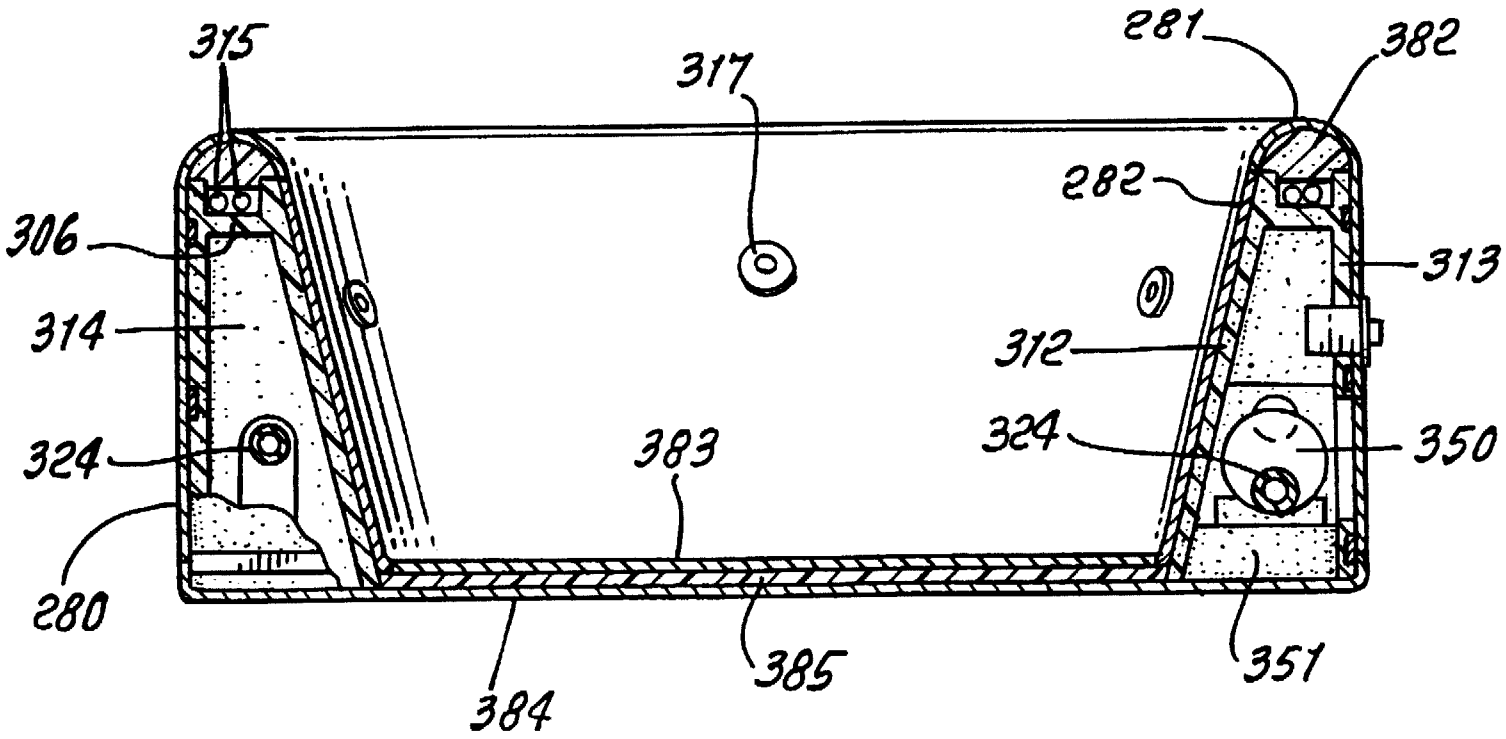
FIG. 9 is a vertical elevation taken in section on lines 9—9 of FIG. 8.
Figure 10:
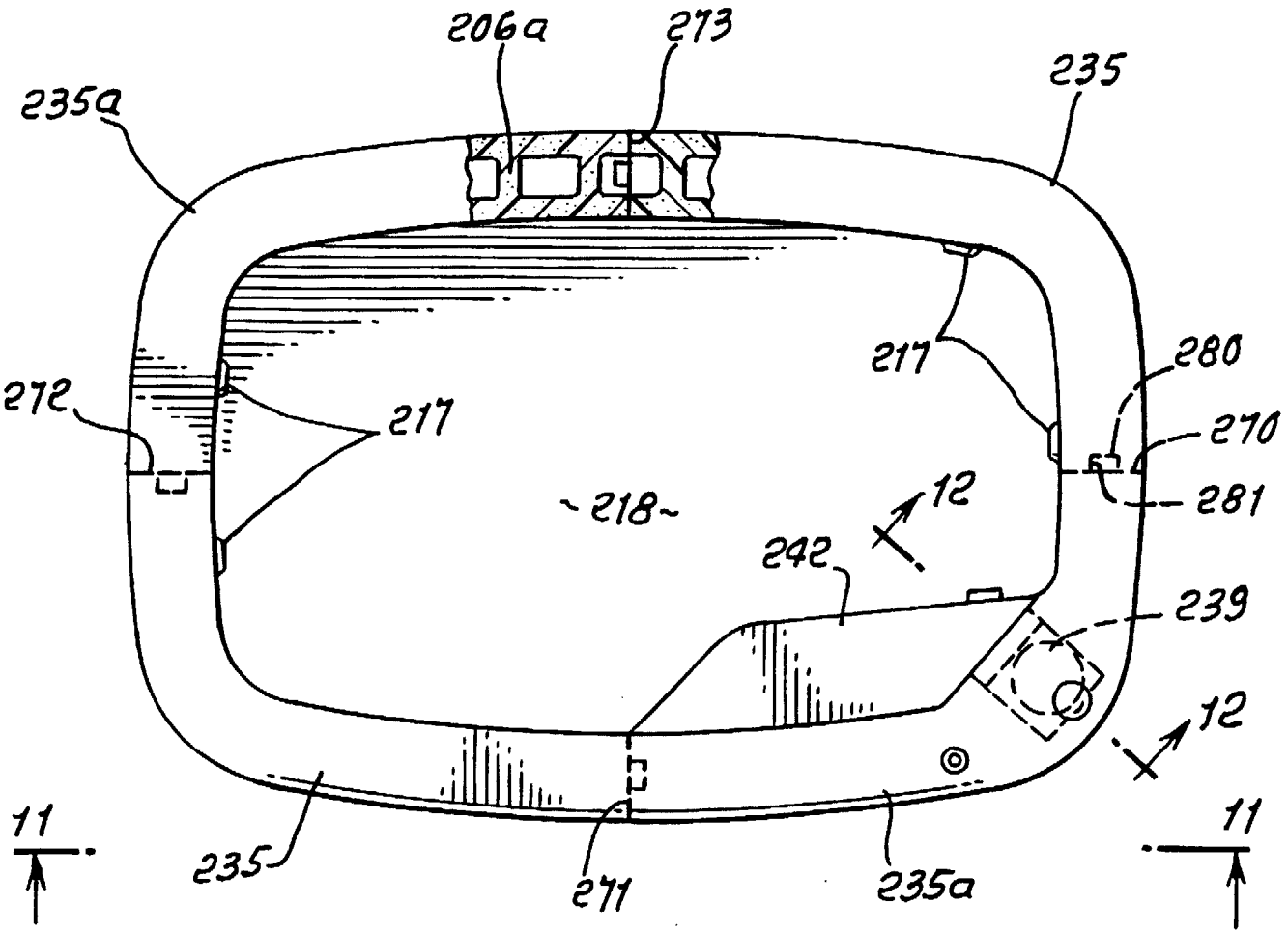
FIG. 10 is a plan view showing still another modification.
Figure 11:
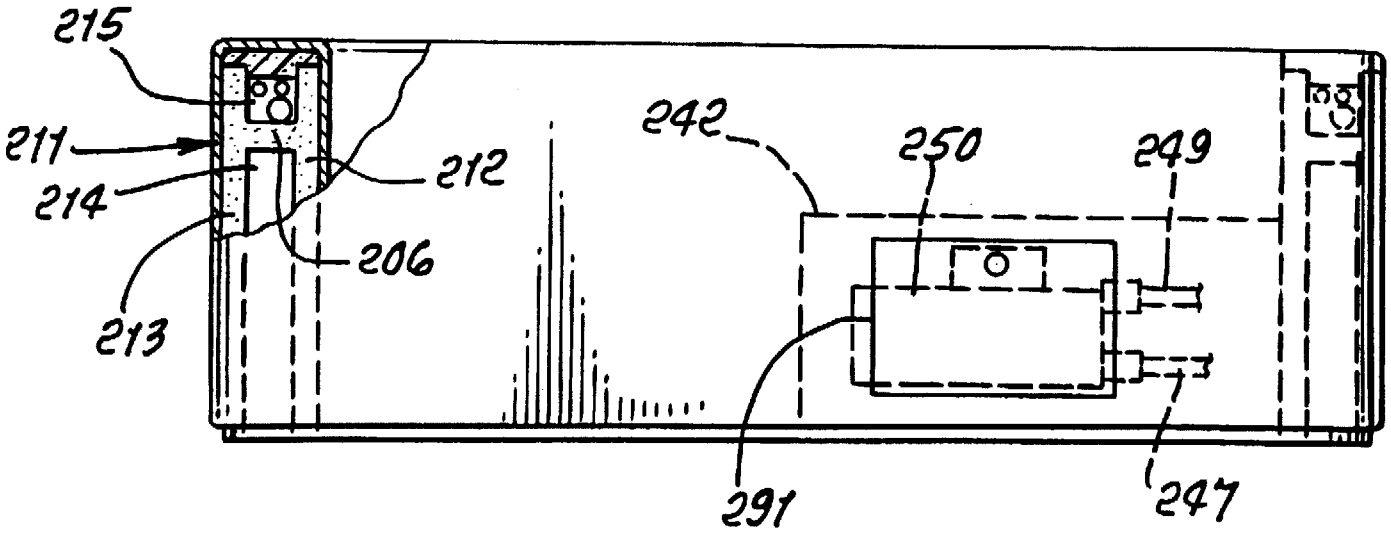
FIG. 11 is an elevation taken on lines 11—11 of FIG. 10, and partly broken away to show interior construction.

In FIGS. 8 and 9, the structure is like that of FIGS. 6 and 7, except that the inner panels 312 diverge downwardly and inwardly from the outer panels 313, as shown. The interior space 314 between such inner and outer panels is thereby enlarged, to contain a motor and pump unit 350 on a base 351, as well as water ducting 314. Note the six sections 335, like sections 135 in FIG. 6. See also T-shaped cap 382.

Drains 370 in the inner panel lead to ducting extending to the pump unit. Air ducting appears at 315, above bridge 306. A filter 339 is carried, as in space 314, and operates as in FIG. 12. Jets are seen at 317. Lining material is indicated at 280--284, and a bottom panel at 285.

Figure 14:
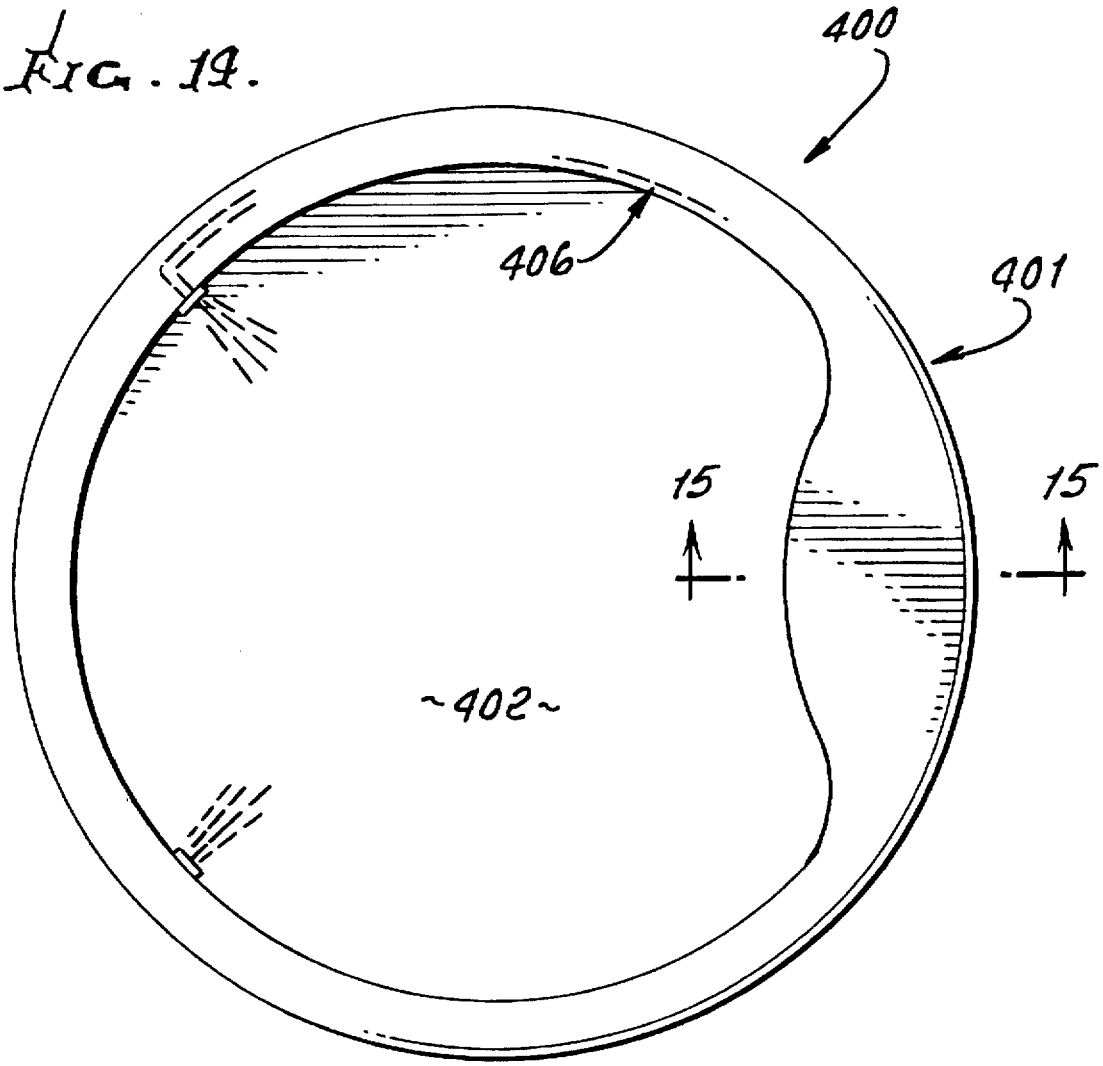
FIG. 14 is a plan view of a modified tub structure.
Figure 15:
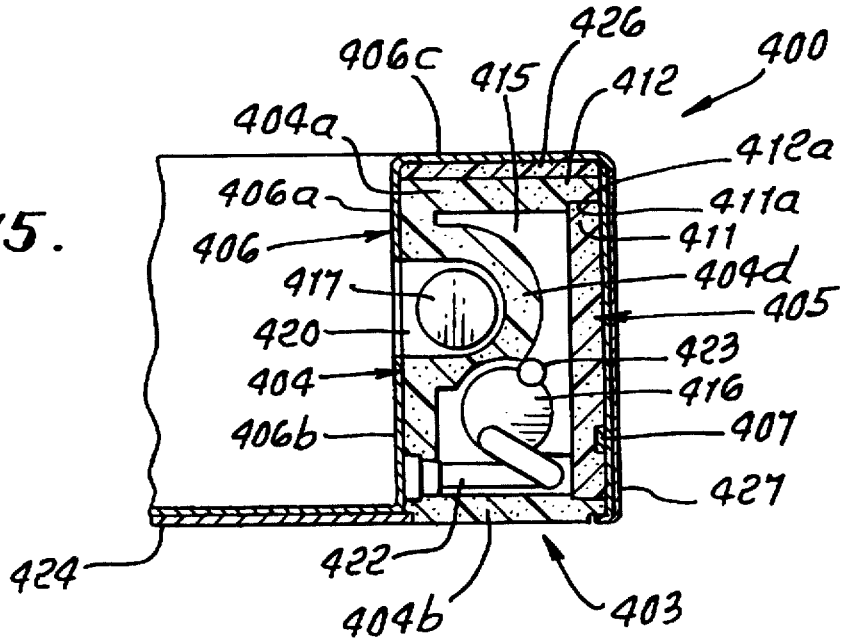
FIG. 15 is a section taken on lines 15—15 of FIG. 14.

In FIG. 14, a spa tab 400 comprises a) a load-bearing tub side wall 401 surrounding a tub interior 402, to receive liquid, such as water;

b) the tub side wall, including inner and outer upright panel structure 403, and consists of molded plastic material which may be foamed, the panel structure including inner panel means 404 and outer panel means 405;

c) a flexible sheet liner 406, for example of plastic, such as vinyl material, at the inner side of the panel structure to transfer hydraulic sideward loading of liquid in interior 402 to the panel structure, the outer panel means 405 located to receive transmission of such loading from the inner panel means 404;

d) and reinforcement means, as for example a band 407 extending about outer panel means 405, to reinforce the outer panel structure to withstand such loading transmission.

The inner and outer panel means or structure defines a unitary wall panel, which is reinforced by the reinforcement means. See for example the interfit at 411 and 412 of the inner and outer panel means, with load-bearing interfit shoulders at 411*a* and 412*a*. A cavity 415 is formed between 404 and 405; and a pump motor 416 and filter elements 417 are located in the cavity as shown, in a radially thickened portion of the side wall.

Upper and lower flanges 404*a* and 404*b* of the inner panel are elongated radially to form the thickened wall; and they may be shortened to reduce the side wall thickness at other locations, eliminating the cavity. Note also the outwardly offset portion 404*d* of panel 404 forming a recess 420 in which the filter is located to communicate directly and radially with the tub interior. Water circulation lines 422 and 423 lead to and from the pump of the pump-motor unit. Bottom wall 424 fits panel structure 404 to reinforce same.

Flexible liner 406 fits against the inner side of the panel means 404, as shown, at 406*a* and 406*b*. The inner liner is suspended from a top liner 406*c*, above a pad 426; and an outer jacket 427 extends downwardly adjacent the outer side of panel means 405. The liner and jacket may consist of vinyl material.

The tub side wall 401 may consist of sections that have end interf it, as described above; or, it may be circumferentially continuous. Suitable piping extends therein to water jets, as described above.

We claim:

1. In the method of providing a spa tub, the steps comprising a) providing a load-bearing tub side wall having an inner side and an outer side, the tub having an interior to receive liquid, b) the tub side wall provided to include at least two wall sections, spaced about said interior, said sections assembled end-to-end to form said side wall to extend in a loop, said sections consisting of foamed synthetic resin, c) each section having inner and outer panels, each panel having opposite ends, whereby adjacent inner panels have opposed opposite ends and adjacent outer panels have opposed opposite ends, the opposed ends of the outer panels offset loopwise from the opposed ends of the inner panels, inner panels connected to outer panels along adjacent sides.

2. The method of claim 1 wherein said tub wall includes at least three of said wall sections.

3. The method of claim 1 wherein cavities are provided between said inner and outer panels, and including locating water ducting in certain of said cavities.

4. The method of claim 2 wherein each of said sections is provided to have two opposite ends, and an intermediate portion, opposed ends of adjacent sections being interconnected, and including retention band means extending in a loop about said sections to resist outward deflection of the sections, and to hold the sections in end-to-end assembled relation.

5. The method of claim 1 wherein each inner panel overlaps adjacent ends of its two outer panels.

6. The method of claim 5 wherein the outer side of each section extends between about 90° and 120° about a vertical axis defined by the tub.

7. The method of claim 1 including providing a flexible liner extending generally vertically at the inner side of said side wall to contain water filled into the tub interior.

8. The method of claim 7 including providing a cover downwardly received in the tub interior and having an inflatable bladder to expand and transmit loading imposed downwardly on the cover to water in the tub beneath the cover.

9. The method of claim 3 wherein said ducting includes jet orifices communicating through said liner.

10. The method of claim 6 wherein said section consists of one of the following:

i) foamed polystyrene ii) foamed polyethylene iii) foamed polypropylene.

11. The method of claim 1 wherein there are at least five of said outer panels and five of said inner panels, each inner panel integrally connected to at least one outer panel.

12. The method of claim 9 wherein there are four of said outer panels and four of said inner panels, each inner panel integrally connected to at least one outer panel, said tub having generally rectangular configuration.

13. The method of claim 1 wherein a) inner panels of certain sections overlap outer panels of other sections, b) inner and outer panels of each section being interconnected, c) the outer panels having greater thickness than said inner panels, and all panels consisting of lightweight, molded plastic material.

14. The method of claim 13 including jet structure including jet orifices that extend inwardly through certain inner panels, said structure acting to hold inner and outer panels together.

15. The method of claim 1 wherein the tub side wall inner side has horizontal outline that is substantially rectangular with curved corners.

16. The method of claim 1 wherein said side wall extends circularly about an upright axis.

17. The method of claim 1 including a cushioned cap extending over said side wall.

18. The method of claim 17 wherein said cap has tongue and groove interfit with said side wall.

19. The method of claim 18 wherein at least one section includes ducting located between said inner and outer panels and below said cap.

20. The method of claim 1 including a tub bottom wall which is connected to said inner panels, all of said panels consisting of lightweight, molded plastic material, the bottom wall acting to structurally reinforce the side panels.

21. The method of claim 1 wherein said outer side is provided to define an upper recess inwardly of the outer side of the tub wall and below the top level of the side wall, the upper recess sized to receive at least one of the following:

i) edge extent of a flexible, outer jacket for the side wall, the jacket extending below said recess, ii) edge extent of a shoulder jacket that extends over the top of the side wall, iii) edge extent of a tub top cover.

22. The method of claim 21 including said flexible, outer jacket installed adjacent the outer side of said wall, with jacket edge extent received in said recess.

23. The method of claim 22 wherein said outer jacket is provided to have a selected color.

24. The method of claim 21 wherein said side wall consists of lightweight, synthetic, resinous material and is semi-rigid and self supporting.

25. The method of claim 1 including webbing extending between said inner and outer panels, said panels and webbing consisting of lightweight, foamed synthetic resin.

26. The method of claim 1 including a seat integral with at least one inner panel and extending into the tub interior.

27. The method of claim 1 wherein there are bridges extending between said inner and outer panels, and integral therewith.

28. The method of claim 27 wherein the bridges extend horizontally and vertically, and form with the panels circularly spaced cavities in the side wall, and upper and lower cavities in the side wall.

29. The method of claim 28 including a water filter in one of said cavities and communicating with the tub interior.

30. The method of claim 29 including a seat in the spa, a chamber below the seat, and a motor and water pump unit in said chamber.

31. The method of claim 1 wherein said inner and outer panels diverge downwardly, and a cavity is formed therebetween, there being a motor and pump unit in said cavity.

32. A spa tub which comprises, in combination:

a) a load-bearing tub side wall surrounding a tub interior to receive liquid, b) the side wall consisting of molded plastic material, c) a flexible liner at the inner side of the inner panel structure to transfer hydraulic loading of said liquid to the inner panel structure, the outer panel structure located to receive transmission of such loading from the inner panel structure, d) there being reinforcement means acting to reinforce the outer panel structure to withstand said loading transmission, e) the tub side wall including at least two wall sections, spaced about said interior, said sections assembled end-to-end to form said side wall to extend in a loop, said sections consisting of foamed synthetic resin, f) each section having opposite ends, and greater thickness intermediate said opposite ends than at said opposite ends, said sections having inner and outer panels, an outer panel of one section connected to an inner panel of another section, along adjacent sides.

33. The combination of claim 32 wherein the inner and outer panel structure defines a unitary wall panel assembly which is reinforced by said reinforcement means.

34. The combination of claim 32 wherein said reinforcement means comprises at least one of the following:

i) strap means looping about said side wall ii) a tub bottom wall extending to said side wall iii) mechanically interfitting joints at ends of sections defined by said side wall.

35. The combination of claim 32 wherein said side wall contains cavity structure, there being at least one of the following in said cavity structure:

i) a pump motor for pumping said liquid to circulate into and out of said interior ii) a filter to filter liquid being circulated into and out of said interior.

36. The combination of claim 35 wherein said side wall has thickness which is increased at the side wall locus containing said cavity structure.

37. The combination of claim 32 wherein each panel has opposite ends, whereby adjacent inner panels have opposed opposite ends and adjacent outer panels have opposed opposite ends, the opposed ends of the outer panels offset loopwise from the opposed ends of the inner panels.

* * * * *